US011284678B2

(12) United States Patent
May

(10) Patent No.: US 11,284,678 B2
(45) Date of Patent: Mar. 29, 2022

(54) RATCHET BELT SYSTEM HAVING INTERCHANGEABLE FACEPLATES AND METHOD THEREFOR

(71) Applicant: Christopher May, Scottsdale, AZ (US)

(72) Inventor: Christopher May, Scottsdale, AZ (US)

( * ) Notice: Subject to any disclaimer, the term of this patent is extended or adjusted under 35 U.S.C. 154(b) by 0 days.

(21) Appl. No.: 16/992,938

(22) Filed: Aug. 13, 2020

(65) Prior Publication Data

US 2021/0059360 A1 Mar. 4, 2021

Related U.S. Application Data

(60) Provisional application No. 62/893,708, filed on Aug. 29, 2019.

(51) Int. Cl.

| | |
|---|---|
| ***A44B 11/00*** | (2006.01) |
| ***A41F 9/00*** | (2006.01) |
| ***A44B 11/25*** | (2006.01) |
| ***A44B 11/06*** | (2006.01) |

(52) U.S. Cl.

CPC ..... *A44B 11/006* (2013.01); *A41F 9/002* (2013.01); *A44B 11/001* (2013.01); *A44B 11/06* (2013.01); *A44B 11/25* (2013.01)

(58) Field of Classification Search

CPC ..... A41F 1/008; A41F 9/002; A44B 11/001; A44B 11/006; A44B 11/06; A44B 11/24; A44B 11/25

See application file for complete search history.

(56) References Cited

U.S. PATENT DOCUMENTS

| | | | | | |
|---|---|---|---|---|---|
| 1,581,822 | A * | 4/1926 | Warden | A44B 11/001 | 40/640 |
| 4,384,390 | A * | 5/1983 | Hayakawa | A44B 11/005 | 224/163 |
| 5,379,493 | A * | 1/1995 | Wu | A44B 11/001 | 24/163 K |
| 5,572,747 | A * | 11/1996 | Cheng | A44B 11/12 | 2/312 |
| 5,579,563 | A * | 12/1996 | Sim | A41F 9/002 | 24/587.12 |
| 5,588,186 | A * | 12/1996 | Ko | A44B 11/14 | 24/170 |
| 5,839,170 | A * | 11/1998 | Cho | A44B 11/06 | 24/163 R |
| 6,098,252 | A * | 8/2000 | Woerth, Jr. | A44B 11/001 | 24/163 K |
| 6,182,388 | B1 * | 2/2001 | Patton | A44B 11/001 | 24/163 K |
| 7,032,415 | B2 * | 4/2006 | Young | A41F 1/008 | 70/18 |
| 8,056,192 | B1 * | 11/2011 | Posner | F16L 33/035 | 24/272 |
| 9,149,090 | B1 * | 10/2015 | Taylor | A44B 11/065 | |
| 9,351,526 | B1 * | 5/2016 | Taylor | A44B 11/16 | |
| 10,130,131 | B2 * | 11/2018 | Ryou | A41F 1/008 | |

(Continued)

*Primary Examiner* — David M Upchurch

(74) *Attorney, Agent, or Firm* — Weiss & Moy, P.C.; Jeffrey D. Moy

(57) ABSTRACT

A belt has a strap. A detachable buckle is attached to a first end of the strap. The detachable buckle has a base. A cutout is formed on a front surface of the base. A removable is faceplate inserted and held within the cutout. A ratchet mechanism secures a second end of the strap within the detachable buckle.

17 Claims, 3 Drawing Sheets

(56) References Cited

U.S. PATENT DOCUMENTS

| | | | | |
|---|---|---|---|---|
| 10,681,963 | B1 * | 6/2020 | Rowland | A41F 9/002 |
| 2009/0178256 | A1 * | 7/2009 | Toth | A44B 11/125 24/71 ST |
| 2013/0167288 | A1 * | 7/2013 | Rowland | A41F 9/002 2/338 |
| 2015/0113770 | A1 * | 4/2015 | Laatz | A47F 5/0006 24/191 |
| 2016/0183636 | A1 * | 6/2016 | Laatz | F41C 33/046 2/312 |
| 2016/0338451 | A1 * | 11/2016 | Scoffier | A41F 9/002 |
| 2017/0020234 | A1 * | 1/2017 | Taylor | A44B 11/005 |
| 2017/0314590 | A1 * | 11/2017 | Hunsucker | A41F 9/002 |
| 2019/0281930 | A1 * | 9/2019 | Taylor | A44B 11/06 |

* cited by examiner

RATCHET BELT SYSTEM HAVING INTERCHANGEABLE FACEPLATES AND METHOD THEREFOR

RELATED APPLICATIONS

This patent application is related to U.S. Provisional Application No. 62/893,708 filed Aug. 29, 2019, entitled "RATCHET BELT ATTACHMENT INTERCHANGEABLE FACE SYSTEM" in the names of Christopher May, and which is incorporated herein by reference in its entirety. The present patent application claims the benefit under 35 U.S.C § 119(e).

TECHNICAL FIELD

The present application relates generally to clothing, and more specifically, to a rachet belt system having interchangeable faceplates that allows one to make incremental adjustments to a size of the belt system and to change the faceplate for a new desired look or function.

BACKGROUND

Belts have been used for years as a way to hold up and secure clothing around a waist of a user. Many clothing items, such as pants, shorts, and the like may come with belt loops formed around the waist of the clothing item. The belt may be placed through the belt loops and secured to hold the clothing item around the waits of the user. To secure the belt, once the belt has been placed through the belt loops, a distal end of the belt may be placed through a belt buckle. A prong of the belt buckle may then be placed through a punch hole formed through the belt. In general, the punch holes may be spaced an inch apart from each other.

The belt when properly tightened, works well for many individuals. Unfortunately, due to the spacing of the punch holes, many people find it difficult to properly tighten the belt around their waist. As such, in the case of many individuals, the lower garment slips down while going through the normal day's activities. Alternatively, in order to prevent the clothing from sagging, the individual may over tighten the belt. This may cause the belt to exert undue pressure around the waist of the individual, especially if the individual is sitting.

Belts may often be used as a fashion accessory. Many individuals purchase various belts in different colors, styles, and finishes to coordinate with the individual's outerwear and activities. Unfortunately, this can be expensive, and lead to storage and organizational issues.

Therefore, it would be desirable to provide a belt that overcomes the above. The belt would allow one to make incremental adjustments to a size of the belt and to change the faceplate for a new desired look or function.

SUMMARY

In accordance with one embodiment, a belt is disclosed. The belt has a strap. A detachable buckle is attached to a first end of the strap. The detachable buckle has a base. A cutout is formed on a front surface of the base. A removable faceplate is inserted and held within the cutout. A ratchet mechanism secures a second end of the strap within the detachable buckle.

In accordance with one embodiment, a belt is disclosed. The belt has a strap. A detachable buckle is attached to a first end of the strap. The detachable buckle has a base. A cutout is formed on a front surface of the base. A removable faceplate is inserted and held within the cutout. Connectors are formed in the cutout removably securing the removable faceplate in the cutout. A ratchet mechanism secures a second end of the strap within the detachable buckle. An opening is formed through the cutout. A clamp is formed on a rear surface of the base on an edge opposite of the ratchet mechanism securing the strap to the detachable buckle.

In accordance with one embodiment, a belt is disclosed. The belt has a strap. A detachable buckle is attached to a first end of the strap. The detachable buckle has a base. A cutout is formed on a front surface of the base. A removable faceplate is inserted and held within the cutout. Connectors are formed in the cutout removably securing the removable faceplate in the cutout. A ratchet mechanism secures a second end of the strap within the detachable buckle. An opening is formed through the cutout. A clamp is formed on a rear surface of the base on an edge opposite of the ratchet mechanism securing the strap to the detachable buckle, wherein the clamp has a handle for locking and unlocking the clamp. A plurality of locking teeth is formed on a rear surface of a second end of the strap. The ratchet mechanism has a housing. A gear is rotatable within the housing. A pawl is coupled to the gear.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
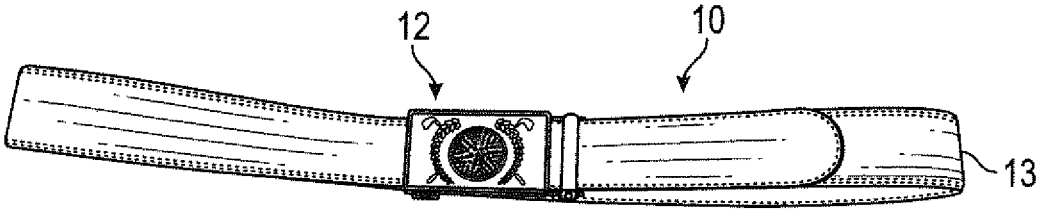
FIG. 1 is an elevated perspective view of an exemplary belt in accordance with one aspect of the present application.
Figure 2:
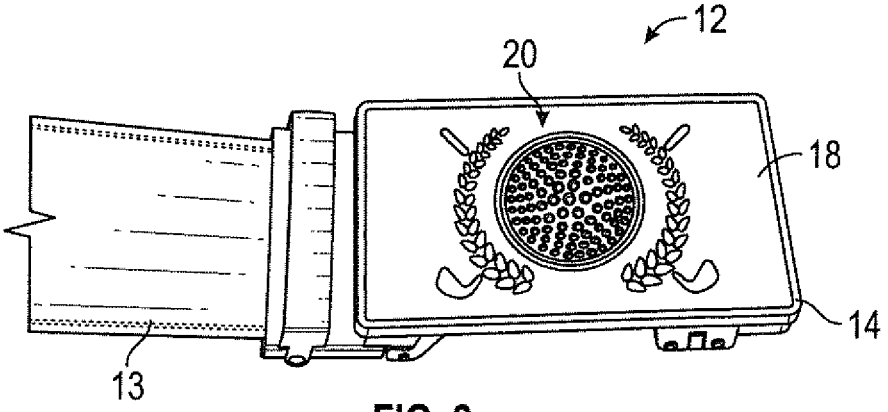
FIG. 2 is a front perspective view of an exemplary buckle used in the belt of FIG. 1 in accordance with one aspect of the present application.
Figure 3:
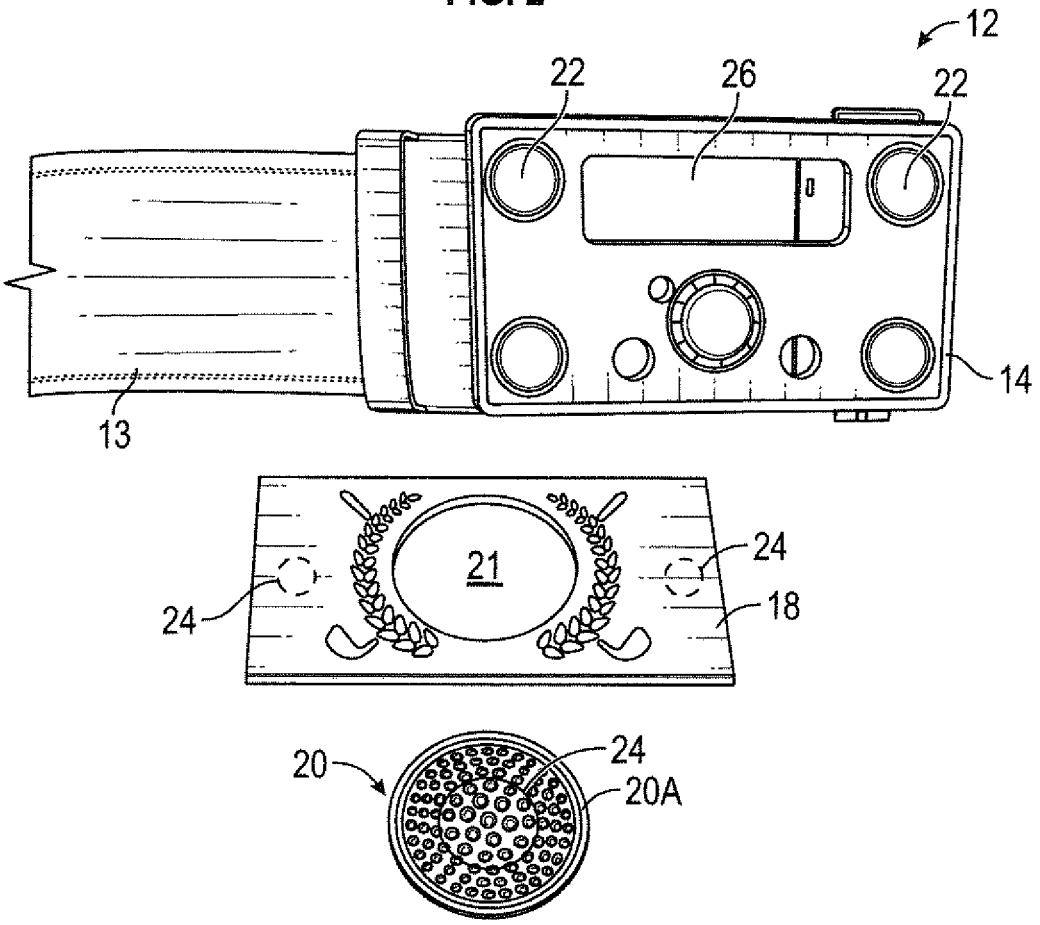
FIG. 3 is an exploded front perspective view of the exemplary buckle used in the belt of FIG. 1 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary belt discloses a ratchet belt buckle to allow a user to make incremental adjustments to a size of the belt. The belt may be designed to incorporate cosmetic and utility interchangeable face plates. These faceplates may be cosmetic for individual daily outerwear or function as a device for work and play. The individual can simply change the faceplate for a new desired look or function. This may allow the individual to use one buckle for every day clothing attire and activities.

Referring to FIGS. 1-7, a belt 10 may be disclosed. The belt 10 may be used to secure clothing around a waist of a user. In general, the belt 10 may be placed through a plurality of belt loops formed along a perimeter of a waist area of the clothing. The belt 10 may be used on clothing such as, but not limited to: pants, shorts, trousers, dresses, skirts, and the like. The belt 10 may allow a user to make incremental adjustments to a size of the belt 10. The belt 10 may be designed to incorporate cosmetic and utility interchangeable face plates to fit a desired look or function of the individual.

The belt 10 may have a detachable buckle 12 and a strap 13. The detachable buckle 12 may be formed of a base 14. The base 14 may have a cut-out 16 formed in a front surface thereof. The cut-out 16 may be sized to hold a removable faceplate 18. By having the removable faceplates 18, an individual may change out the removable faceplate 18 to fit a desired look or function of the individual. For example, in FIG. 1, the removable faceplate 18 may be golf themed. Thus, the individual may use the removable faceplate 18 shown in FIG. 1 to go golfing. As may be shown in FIGS. 1-3, the removable faceplate 18 may be formed of multiple parts. As may be seen in FIG. 3, the removable faceplate 18 may have a removable portion 20. The removable portion 20 may allow one to further customize the removable faceplate 18. In the embodiment shown in FIGS. 1-3, since the removable faceplate 18 may be golf themed, the removable portion 20 may be an additional golf themed item. For example, the removable portion 20 may be a golf ball marker 20A. The above is given as an example and should not be seen in a limiting manner. The removable portion 20 may be any type of accessory to match a desired look or function of the individual. A hole 21 may be formed through the removable faceplate 18. The hole 21 may be used to push and remove the removable portion 20 from the removable faceplate 18.

To secure the removable faceplate 18 and the removable portion 20 within the cut-out 16, connectors 22 may be used. In accordance with one embodiment, one or more connectors 22 may be applied on a bottom surface of the cut-out 16 formed in the base 14. These connectors 22 may attract and hold the removable faceplate 18 and the removable portion 20 within the cut-out 16. In accordance with one embodiment, the connector 22 may be magnets with the removable faceplate 18 and the removable portion 20 being formed of a ferromagnetic material and/or having an insert formed of a ferromagnetic material. Alternatively, the removable faceplate 18 and the removable portion 20 may be formed of a non-magnetic material and have magnets 24 attached thereto that attach to the magnets 22. The above is given as examples and should not be seen in a limiting manner. Other types of attachment devices may be used for the connectors 22 without departing from the spirt and scope of the present invention.

An opening 26 may be formed through the cut-out formed in the base 14. The opening 26 may be sized to allow the individual to use a finger or other object to apply pressure to push the removable faceplate 18 and/or the removable portion 20 out from the cut-out 16 so the individual may change out the removable faceplate 18 and/or the removable portion 20. For example, the removable faceplate 18 shown in FIGS. 1-3 may be replaced with another removable faceplate 18 shown in FIG. 7. Thus, the individual may remove the golf themed removable faceplate 18 shown in FIGS. 1-3 and insert a US Flag removable faceplate 18 shown in FIG. 7. The removable faceplate 18 may come in other designs than those shown in the Figures to match a desired look or function of the individual.

While the removable faceplate 18 may be shown as being rectangular in shape, the design of the removable faceplate 18 may be formed in a variety of shapes and sizes. The removable faceplate 18 may also be designed for different utility and function. For example, the removable faceplate 18 may be designed to have functions such as, but not limited to: boxes, pill boxes, medical alert devices, flash lights, knives, figurines, lighters, pens, keys, bottle openers, time pieces, phone accessories, camping uses, golf ball markers and divot tools and the like.

Figure 4:
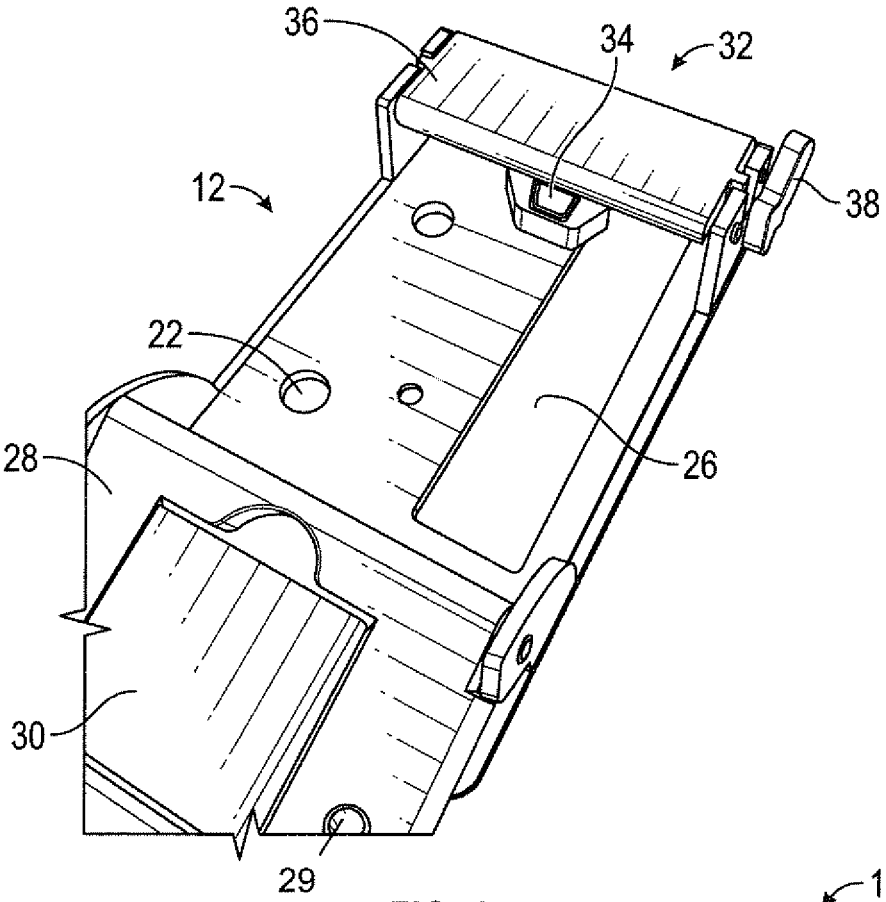
FIG. 4 is a rear perspective view of the exemplary buckle used in the belt of FIG. 1 in accordance with one aspect of the present application.
Figure 5:
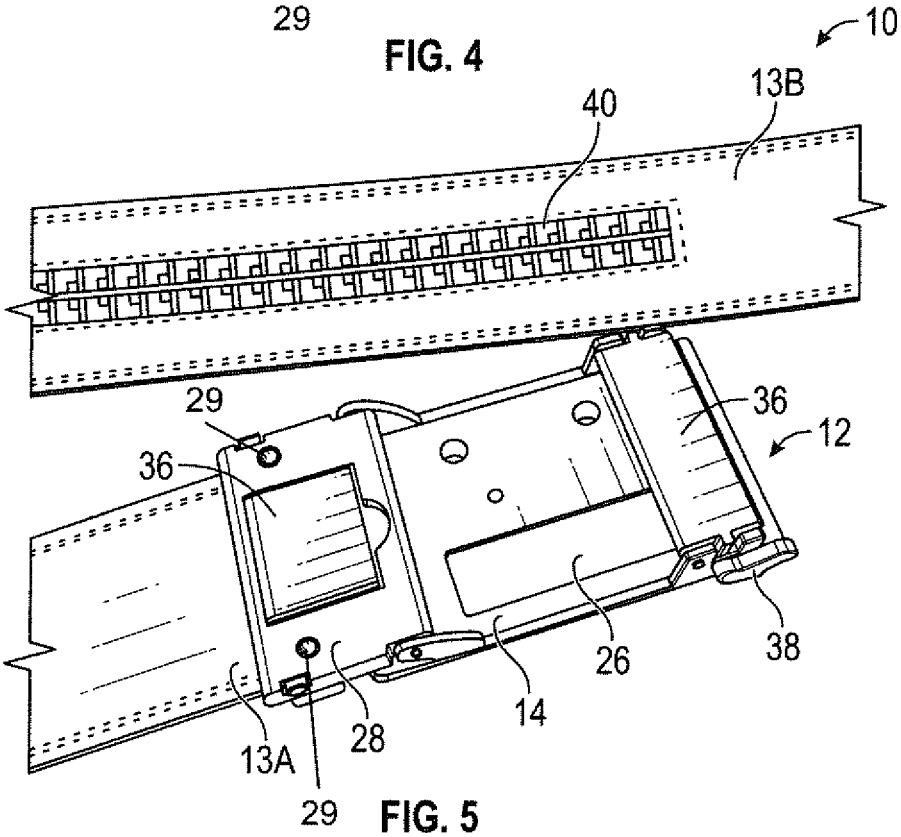
FIG. 5 is a rear perspective view of the exemplary buckle with a face plate removed and the strap used in the belt of FIG. 1 in accordance with one aspect of the present application.
Figure 6:
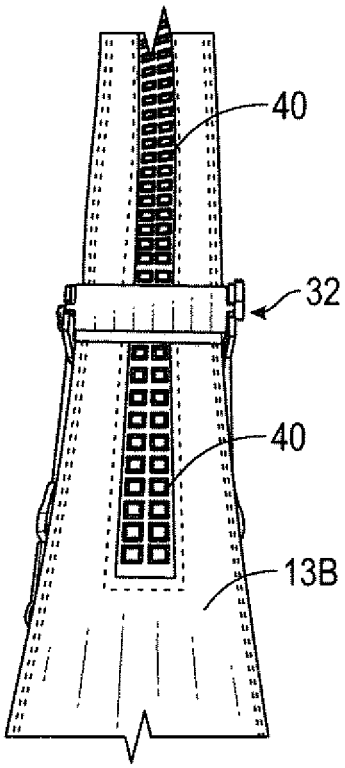
FIG. 6 is a rear perspective view of the exemplary buckle and the strap used in the belt of FIG. 1 in accordance with one aspect of the present application.
Figure 7:
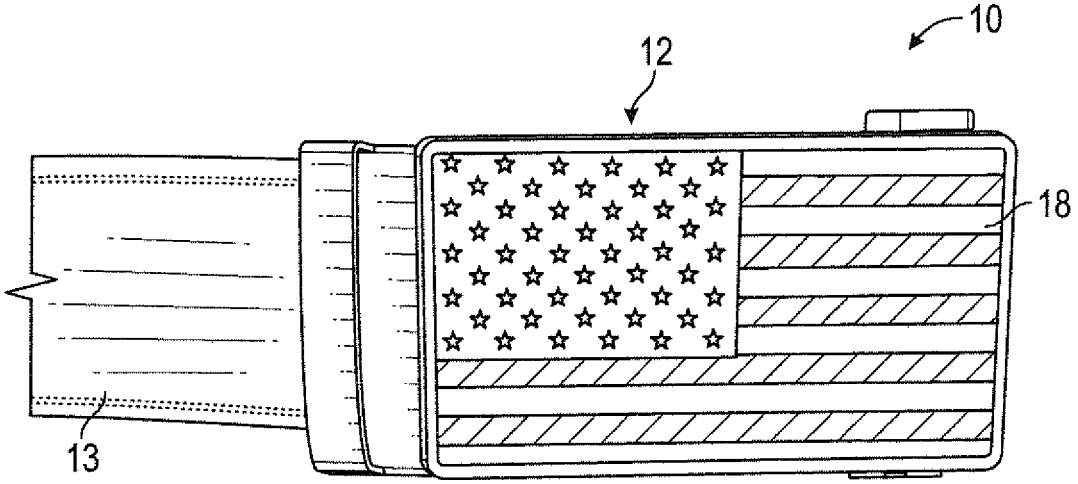
FIG. 7 is a front perspective view of an exemplary buckle used in the belt of FIG. 1 in accordance with one aspect of the present application.

As may be shown in FIG. 4-5, the detachable buckle 12 may have a clamp 28. The clamp 28 may be formed on a rear surface of the base 14. The clamp 28 may be used to removable attach the detachable buckle 12 to a first end 13A of the strap 13. In accordance with one embodiment, the clamp 28 may be a spring-loaded clamp having a lever 30. By raising the lever 30, tension on the spring-loaded clamp may be released thereby allowing the individual to remove the detachable buckle 12 from the first end 13A of the strap 13. By pressing the lever 30 downward, tension may be applied to the spring-loaded clamp thereby securing the detachable buckle 12 to the first end 13A of the strap 13.

In accordance with one embodiment, the clamp 28 may have fasteners 29. The fasteners may be used to further secure the detachable buckle 12 to a first end 13A of the strap 13. The fasteners 29 may be a removable screw or other similar type of removable fastener.

The detachable buckle 12 may use a rachet mechanism 32. The ratchet mechanism 32 may be used to secure a second end 13B of the strap 13 within the detachable buckle 12. In the present embodiment, the ratchet mechanism 32 may be attached on the rear surface of the base 14 on a side opposite of the clamp 28. The ratchet mechanism 32 may be formed of a gear 34. The gear 34 may be housed within a support structure 36. The support structure 36 may allow the gear 34 to rotate therewithin. A pawl 38 may be coupled to the gear 34. The pawl 38 may engage with teeth of the gear 34 thereby preventing movement of the gear 34.

On a rear surface of the second end 13B of the strap 13 may be a plurality of locking teeth 40. Each of the plurality of locking teeth 40 may be arranged directly adjacent to an adjoining locking tooth 40 thereby allowing for minute changes in length of the belt 10.

In operation, the individual using the belt 10 may pull back on the pawl 38 to release the gear 34. The individual may then insert the second end 13B of the strap 13 into a slot 42 formed in a front bottom area of the support structure 36. The individual may then release the pawl 38 so that the teeth of the gear 34 engages with the locking teeth 40 on the strap 13 when the belt is at the correct length. The rachet mechanism 32 may be designed so that the individual may pull the strap 13 to further tighten the strap 13 around a waist of the individual, however, the ratchet mechanism 32 may not rotate in the opposing direction unless the pawl 38 is pulled back to release the gear 34.

The belt 10 may allow for micro-adjustments to a length of the belt 10 for optimal belt sizing without the need for holes in belt 10 through the use of the rachet mechanism 32. The belt 10 has a detachable buckle 12 that has removable faceplates 18 that may be interchanged. These removable faceplates 18 may be cosmetic for consumer daily outerwear or function as a device for work and play. The individual can simply change the removable faceplate 18 for a new desired look or function. This may allow the individual use one detachable buckle 12 for every day clothing attire and activities.

The foregoing description is illustrative of particular embodiments of the application, but is not meant to be a limitation upon the practice thereof. The following claims, including all equivalents thereof, are intended to define the scope of the application.

What is claimed is:

1. A belt comprising:
a strap; and
a detachable buckle attached to a first end of the strap, wherein the detachable buckle comprises:
a base;
a cutout formed on a front surface of the base;
a removable faceplate inserted and held within the cutout;
a ratchet mechanism securing a second end of the strap within the detachable buckle; and
connectors formed in the cutout removably securing the removable faceplate in the cutout, wherein the connectors are a plurality of magnets formed in a bottom area of the cutout.

2. The belt of claim 1, comprising an opening formed through the cutout.

3. The belt of claim 1, comprising a clamp formed on a rear surface of the base on an edge opposite of the ratchet mechanism securing the strap to the detachable buckle.

4. The belt of claim 3, wherein the clamp has a handle for locking and unlocking the clamp securing and releasing the strap from the detachable buckle.

5. The belt of claim 3, wherein the clamp is a spring-loaded clamp.

6. The belt of claim 1, wherein the ratchet mechanism comprises:
a housing;
a gear rotatable within the housing; and
a pawl coupled to the gear.

7. The belt of claim 1, comprising a plurality of locking teeth formed on a rear surface of a second end of the strap.

8. The belt of claim 1, comprising an accessory removably attached to the faceplate.

9. The belt of claim 1, comprising:
a hole formed through the faceplate; and
an accessory positioned over the hole.

10. A belt comprising:
a strap;
a detachable buckle attached to a first end of the strap, wherein the detachable buckle comprises:
a base;
a cutout formed on a front surface of the base;
a removable faceplate inserted and held within the cutout;
connectors formed in the cutout removably securing the removable faceplate in the cutout, wherein the connectors are a plurality of magnets;
a ratchet mechanism securing a second end of the strap within the detachable buckle;
an opening formed through the cutout; and
a clamp formed on a rear surface of the base on an edge opposite of the ratchet mechanism securing the strap to the detachable buckle.

11. The belt of claim 10, wherein the clamp has a handle for locking and unlocking the clamp.

12. The belt of claim 10, wherein the clamp is a spring-loaded clamp.

13. The belt of claim 10, wherein the ratchet mechanism comprises:
a housing;
a gear rotatable within the housing; and
a pawl coupled to the gear.

14. The belt of claim 10, comprising a plurality of locking teeth formed on a rear surface of a second end of the strap.

15. The belt of claim 10, comprising an accessory removably attached to the faceplate.

16. The belt of claim 10, comprising:
a hole formed through the faceplate; and
an accessory positioned over the hole.

17. A belt comprising:
a strap;
a detachable buckle attached to a first end of the strap, wherein the detachable buckle comprises:
a base;
a cutout formed on a front surface of the base;
a removable faceplate inserted and held within the cutout;
a hole formed through the faceplate;
an accessory positioned over the hole formed through the faceplate;
a ratchet mechanism securing a second end of the strap within the detachable buckle.

* * * * *